US006880913B2

(12) United States Patent
Suzuki

(10) Patent No.: US 6,880,913 B2
(45) Date of Patent: Apr. 19, 2005

(54) LIQUID EJECTING DEVICE

(75) Inventor: Kazunaga Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/463,876

(22) Filed: Jun. 18, 2003

(65) Prior Publication Data

US 2004/0036736 A1 Feb. 26, 2004

(30) Foreign Application Priority Data

Jun. 18, 2002 (JP) ..... P2002-177672

(51) Int. Cl.[7] ..... B14J 2/165

(52) U.S. Cl. ..... 347/23; 347/29; 347/30; 347/35

(58) Field of Search ..... 347/23, 29, 30, 347/35

(56) References Cited

U.S. PATENT DOCUMENTS 6,042,218 A * 3/2000 Nakahara ..... 347/35
6,283,573 B1 * 9/2001 Nakamura ..... 347/23

FOREIGN PATENT DOCUMENTS

EP 1013435 A1 * 6/2000 ..... B41J/2/165

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

A liquid ejecting device includes a liquid ejecting head which has a nozzle formation face on which nozzle orifices for ejecting liquid drops are formed and a controller which performs a recovery operation for removing a liquid having a changed liquid property. The recovery operation is performed by using at least a flushing mode in which liquid drops are ejected in a state that the nozzle formation face is sealed. The controller selectively performs a plurality of flushing modes which are set in accordance with degrees in change of a liquid property of the liquid drops being at and near the nozzle orifices. The degrees in change of the liquid property of the liquid drops are determined by a relation between an accumulative time that the nozzle orifices are left in a sealing state and an accumulative time that a liquid ejection is executed. A high flushing mode of the flushing modes for removing the liquid having a high degree in change of the liquid property has a first flushing mode which is performed at a first time and second and subsequent flushing modes which is performed at a second and subsequent time. The number of liquid drops ejected in the first flushing mode is greater than the number of liquid drops ejected in the second and sequent flushing modes.

9 Claims, 7 Drawing Sheets

LIQUID EJECTING DEVICE

BACKGROUND OF THE INVENTION

The present invention relates to a liquid ejecting device which ejects a liquid pressurized in a pressure generating chamber in the form of liquid drops through nozzle orifices.

There is known a liquid ejecting device of the type which ejects a liquid pressurized in a pressure generating chamber in the form of liquid drops through nozzle orifices, and the liquid ejecting device is capable of ejecting any of various kinds of liquids. A typical example of such a liquid ejecting device is a recording head used in an ink jet recording device. A related technique will be described by using the recording head of the ink jet recording device, and with reference to FIGS. 6 and 7.

The recording head includes a flow passage unit 1 having nozzle orifices 2 and a head case 9 in which the flow passage unit 1 is attached thereto by bonding.

The flow passage unit 1 is formed with a nozzle plate 3, a passage substrate 5 and a vibration plate 6, which are laminated into a unit form. The nozzle plate 3 has a nozzle forming surface 3A in which an array of nozzle orifices 2 are formed. The passage substrate 5 includes an array of pressure generating chambers 4 formed therein which respectively communicate with the nozzle orifices. The vibration plate 6 closes the openings of lower parts of the pressure generating chambers 4. Ink reservoirs 8 are formed in the passage substrate 5. Each ink reservoir 8 communicates with the pressure generating chamber 4 associated therewith via an ink passage 7, and reserves ink to be fed to the pressure generating chamber 4. The whole recording head is denoted as H.

The head case 9, which forms a base member of the recording head H, is formed by injection molding using thermosetting resin or thermoplastic resin. A pressure generating element 11 is placed in a space 10 which vertically extends in the structure. A back end of the pressure generating element 11 is fixed to a fixing plate 12 mounted on the head case 9, and a fore end of the same is fixed to a island 6A on the lower surface of the vibration plate 6.

A pressure generating chamber 4, a pressure generating element 11 and a nozzle orifice 2 are vertically arranged in the structure. A number of combinations each consisting of them are arrayed in a direction perpendicular to a surface of the drawing. In this instance, two linear arrays of nozzle orifices are formed. Those nozzle linear arrays eject ink such that the same kind of ink is ejected for each nozzle linear array.

Conducting wires for input 13 are connected to the pressure generating elements 11, respectively. The conducting wires are inserted into and passed through through-holes 14A of a head substrate 14, and then connected to printed wirings 15 on the head substrate 14. The printed wirings 15 are gathered and connected to a flexible flat cable 17 via a connector 16. The flexible flat cable 17 is connected to a drive circuit (not shown). When a drive signal is input from the drive circuit to the pressure generating element 11, the pressure generating element 11 is expanded and contracted in the longitudinal direction to vary a pressure within the pressure generating chamber 4. Then, the ink within the pressure generating chamber 4 is ejected through the nozzle orifices 2 in the form of ink drops.

A damper recess 18 is formed at a part of the head case 9 corresponding to each ink reservoir 8. When ink is ejected, the damper recess damps a pressure variation in the ink reservoir 8 with the aid of the vibration plate 6 formed with a polyphenylene sulfide film (referred to as a PPS film). The damper recess 18 is a space isolated from exterior. Air in the damper recess 18 flows out into the ink so as to permeate through the vibration plate 6 formed with the PPS film. An air pressure in the damper recess 18 decreases, and a tension of the vibration plate 6 becomes high. As a result, an unsatisfactory damping effect is frequently obtained. To cope with this, a communication passage 9, which enables the damper recess 18 to communicate with the air, is provided extending from the bottom surface of the damper recess 18 to the opposite surface of the head case 9, to thereby prevent the pressure reduction within the damper recess 18.

In the above structure, an opening area of the damper recess 18 is large, and hence, an area of the vibration plate 6, which covers the opening area, is also large. In particular, when the ink jet recording device is put in a non-use state, the water content of the ink evaporates and permeates through the vibration plate 6 having the large opening area, and flows into the damper recess 18. With its pressure increase, the vapor passes through the communication passage 19 and scatters into the air. In such a phenomenon, the amount of water in the ink decreases and a viscosity of ink increases. As a result, when the ink jet recording device is operated again, the ink drop ejection is improper. To avoid this, a passage resistance of the communication passage 19 is increased to thereby prevent the excessive evaporation of the water content of the ink.

The ink jet recording device designed for the color printing uses plural kinds of color inks of yellow, magenta, cyan and the like, in addition to black ink. Further, nozzle orifices 2 are provided which are respectively assigned for those colors.

When the print data terminates and the recording head H is put in a non-use state, ink presented at a vicinity of the nozzle orifices 2 is dried, so that the nozzle orifices will be clogged with the dried ink. For this reason, in the related technique, the recording head H is sealed with the cap when no printing operation is performed. When the recording head is left in a sealed state for a long time, a solvent of the ink presented at the vicinity of the nozzle orifices 2 gradually evaporates and a viscosity of the ink increases. In a state that the viscosity of the ink is increased, some troubles tend to occur. For example, the printing operation cannot start quickly or a print quality is deteriorated. The nozzle orifices 2, which continuously ejects ink drops in the printing operation, successively receive new ink, and little suffers from the clogging. In the case of the nozzle orifices 2, which are located, for example, at the upper and lower ends of the nozzle array, and have each an extremely small chance of ejecting ink drops, the ink located near those nozzle orifices 2 dries during the printing operation and its viscosity increases, and the recording head is likely to be clogged with the dried ink.

To cope with such a problem, a "flashing operation" or "cleaning operation" is performed for one form of a preparatory operation before the printing operation starts. In the preparatory operation, at a time point that power to the recording device is turned on or that a print signal is first input to the recording device, the nozzle orifices 2 are forcibly caused to eject ink drops independently of the printing, whereby the clogging is removed and the ink ejection ability of the recording head is recovered.

The "flushing operation" removes the ink having an increased viscosity presented at the vicinity of the nozzle orifices 2 in a manner that a drive signal is applied to the pressure generating element 11 independently of print data, and the recording head is caused to eject ink drops of such an ink. The "cleaning operation" is performed when the clogging of the nozzle orifices 2 is not removed completely by only the "flushing operation. In the "cleaning operation", a negative pressure is applied to the nozzle orifices 2 by use of a suction pump thereby to forcibly suck the ink of the increased viscosity in the pressure generating chambers 4 and others.

The viscosity of the ink presented at the vicinity of the nozzle orifices 2 is more increased and the clogging of the nozzle orifices 2 is more deteriorated as a time (cap leaving time) that the recording head H is left as it is sealed with the cap and a total printing time till the recording head is sealed with the cap are longer. Which of the "flushing operation" and the "cleaning operation" is to be performed is determined by a relation (correlation) between the cap leaving time and the total printing time as shown in FIG. 7. When the cap leaving time or the total printing time is short, the flushing operations in a flushing region indicated by FL1 to FL4 are performed. When the cap leaving time or the total printing time is long, the cleaning operation in the cleaning region is performed.

As shown in FIG. 7, the flushing region that is determined by a relation (correlation) between the cap leaving time and the total printing time, is layered into four regions (FL1 to FL4 in this instance) depending on a level of viscosity increase of the ink at and near the nozzle orifices 2. In the region FL1, a degree of the viscosity increase of the ink at and near the nozzle orifices 2 is the lowest. In this degree, to recover the ink ejection ability of the nozzle orifices 2, the black ink (BK) is ejected by 100 shots, and the color ink (COL) is ejected by a small number of shots, 50 shots.

When the cap leaving time or the printing time is somewhat longer than that in the flushing region FL1, the increase degree of the ink at and near the nozzle orifices 2 somewhat increases from that in the flushing region FL1. Therefore, the recovering operation is performed in a flushing region FL2. To recover the ink ejection ability of the nozzle orifices 2, the black ink BK is ejected by 1000 shots, and the color ink COL is ejected by 500 shots, larger than in the flushing region FL1.

In this way, the recovering region is stepwise shifted and finally a flushing region FL4 is reached in which the ink viscosity increase degree is the highest. In this flushing region, the black ink BK is ejected by 5000 shots, and the color ink COL is ejected by 3000 shots to thereby recover the ink ejection ability of the nozzle orifices.

The recovering operations are performed before an operation job is executed. The operation job consists of an ink ejection operation of the recording head H, which ranges from an instant that the recording head H starts an ink ejection in response to an operation command signal applied thereto till the recording head ends the ink ejection. In a specific example where the recording head receives a one-operation command signal, which instructs a print of a letter of 3 pages and starts an ink ejection for printing the letter, an operation of the recording head ranging from the start to the end of the Ink injection forms one operation job. The recovering operation in any of the recovering regions is performed before the operation job. In another example where another operation command signal to print a short sentence of about 5 lines after the printing of the letter ends is applied, for another operation job, to the recording head H, the recovering operation in any of the recovering operation regions is performed before the printing operation of the short sentence starts.

When the recovering operation of the recording head shifts from the flushing operation defined by the regions FL1 to FL4 to the cleaning operation, the cleaning operation is performed before the operation job starts. By the cleaning operation, the ink having the considerably increased viscosity is forcibly sucked from the nozzle orifices 2 of the recording head, to thereby recover the normal ink ejection ability of the recording head. After the cleaning operation is performed, a state of the ink at and near the nozzle orifices 2 is returned to a state substantially equal to the initial state that the ink having increased viscosity is removed. Then, the cap leaving time or the printing time is reset, and both the times are counted again from the start.

When the cap leaving time or the printing time is long and the recovering operation is set to the region FL4, the ink-shot recovering operation is performed every operation job till the recovering operation shifts from the region FL4 to the cleaning region. As in the above case, the black ink BK is ejected by 5000 shots and the color ink COL is ejected by 3000 shots before the printing of the letter of three pages starts, whereby the ink having the most increased viscosity is removed and a normal print quality is secured. Also when the short sentence having about five lines is printed after a relatively short time from the printing of the letter, as in the above case, the recovering operation is performed by ejecting the ink by the same numbers of shots before the printing operation starts, if the recovering operation sequence is set within the region FL4.

This is due to the fact that the flushing operation is executed every job since the recovering operation sequence prepared in advance is set in the region FL4. Therefore, if once the recovering operation sets the region FL4, the flushing operation of the region FL4 in which the number of shots is large is repeated till the recovering operation leaves the region and sets to the cleaning region. As a result, a long printing time is consumed. When such a flushing operation assigned to the region FL4 is repeated for each operation job, the ejection ink is wasted and this is uneconomical. Further, a large space for storing a waste ink is required. This hinders the device size reduction.

SUMMARY OF THE INVENTION

It is therefore an object of the present invention to provide a liquid ejecting device which enables a flushing operation assigned to a high liquid-property change region to be efficiently performed.

In order to achieve the above object, according to the present invention, there is provided an liquid ejecting device comprising:

a liquid ejecting head, having a nozzle formation face on which nozzle orifices for ejecting liquid drops are formed; and a controller, which performs a recovery operation for removing liquid drops having a changed liquid property, the liquid drops being at and near the nozzle orifices;

wherein the recovery operation is performed by using at least a flushing mode in which liquid drops are ejected in a state that the nozzle formation face is sealed;

wherein the controller selectively performs a plurality of flushing modes which are set in accordance with degrees in change of a liquid property of the liquid drops being at and near the nozzle orifices;

wherein the degrees in change of the liquid property of the liquid drops are determined by a relation between an accumulative time that the nozzle orifices are left in a sealing state and an accumulative time that a liquid ejection is executed;

wherein a high flushing mode of the flushing modes for removing the liquid having a high degree in change of the liquid property has a first flushing mode which is performed at a first time and second and subsequent flushing modes which is performed at a second and subsequent time; and wherein the number of liquid drops ejected in the first flushing mode is greater than the number of liquid drops ejected in the second and sequent flushing modes.

In the above configuration, the liquid having the high degree in change of the liquid property is removed by the liquid ejection of the predetermined amount of liquid in the first flushing modes. As a result, the recovered nozzle orifices are prepared for its normal liquid ejection. When the second and subsequent flushing modes of the high flushing mode are performed, a time taken for the second and subsequent flushing modes is reduced, and hence, an operation time of the liquid ejecting device is reduced since the liquid ejection amount in the second and subsequent flushing modes is smaller than that in the first flushing mode. The second and subsequent flushing modes are controlled in a minimum level, so that an amount of fresh liquid consumed by the flushing mode is minimized, and an economical liquid ejecting device is provided.

Preferably, the recovery operation is performed before an operation job is executed, and the operation job is executed during from an instant that the liquid ejecting head starts a liquid ejection in response to an operation command signal applying thereto till the liquid ejecting head ends the liquid ejection. In the above configuration, the flushing modes are performed before the operation job is executed, for example, the liquid ejecting head starts to eject a liquid to one object under liquid ejection. Accordingly, when the liquid is ejected to the object, the highly property changed liquid has completely been removed, and hence, a normal liquid ejection is secure.

Preferably, ranges of the degrees in change of the liquid property which are correspond to the flushing modes respectively are defined in accordance with an environmental condition having at least one of temperature and humidity at a location where the liquid ejecting device is disposed. In the above configuration, optimum ranges of the degrees in change of the liquid property which is adaptable for every condition around the liquid ejecting head is realized. Accordingly, a flushing mode which is most suitable for changes of liquid properties of the liquid may be performed.

Preferably, a liquid ejection amount in at least one of the flushing modes is changed in accordance with an environmental condition having at least one of temperature and humidity at a location where the liquid ejecting device is disposed. In the above configuration, if the liquid ejection amount in the winter season and cold districts is set to be larger than that in the summer season and warm-temperature districts, the liquid ejection amount in the flushing operation being adapted for the environmental conditions is secured. Accordingly, a good recovering operation is performed at the nozzle orifices.

Preferably, the first flushing mode is initially performed after the power to the liquid ejecting device is turned on. In the above configuration, the first flushing mode to first be secured by the liquid ejection amount is performed without fail. The recovery at and near the nozzle orifices is reliably achieved. The second and subsequent flushing modes, which are executed in a state that the power source of the liquid ejecting device is in an on state, are frequently executed after not so long time elapses from the execution of the first flushing mode. Therefore, the function of the nozzle orifices can surely be recovered even if an liquid ejection amount smaller than that for the first flushing mode is used.

Preferably, a liquid ejection amount in the first flushing mode of the high flushing mode is larger than that in the flushing modes other than the high flushing mode. In the above configuration, a time taken for the flushing mode performed for each operation job in the high flushing mode and an amount of waste liquid are larger than those in other flushing modes. In this respect, the effect to reduce the liquid ejection amounts in the second and subsequent flushing modes is remarkable. A flushing mode is performed by the liquid ejection of an liquid ejection amount suitable for a property change degree. In particular, the flushing mode is performed by use of the ejection liquid whose amount is increased as the result of removing the liquid having the highest property change degree. A more exact recovering operation is performed at and near the nozzle orifices.

Preferably, the liquid is an ink for printing and is used for an ink jet recording device. The flushing mode is applied to a property change of the ink, so that a normal ink ejection is secured and a good print quality is ensured. Further, a small space for storing the waste ink is required. This feature is advantageous to the device size reduction.

Preferably, the liquid having a changed liquid property is an ink increased in its viscosity at and near the nozzle orifices. The ink whose viscosity is increased at and near the nozzle orifices of the recording head of the ink jet recording device is removed by the first flushing mode in the high flushing mode, so that the nozzle orifices are prepared for their normal ink ejection. Since the ink ejection amount in the second and subsequent flushing modes is smaller than that in the first flushing mode, the second and subsequent flushing modes performed before the printing of a second document, for example, starts is completed for a short time, and the amount of ink ejected is small. This provides an economical feature of the invention. Accordingly, a rational recovering operation is secured when the liquid have a high viscosity increase degree which is determined by the relation between an accumulative time that the nozzle orifices is left in a sealed state and an accumulative time that the ink ejection is performed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of the present invention will be described in detail with reference to the accompanying drawings.

A liquid ejecting device of the invention is operable to eject any of various kinds of liquids, as described above. In an illustrated embodiment, the liquid ejecting device is typically applied to an ink jet recording device.

Figure 1:
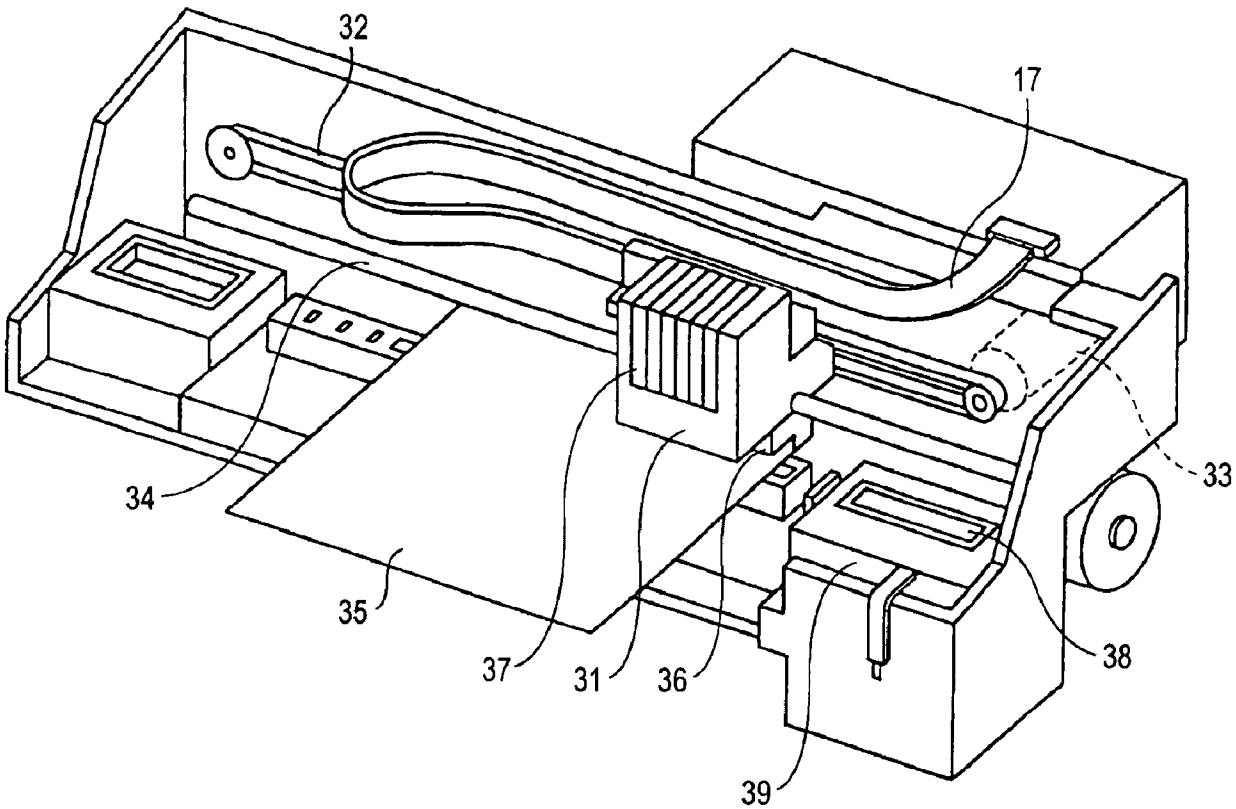
FIG. 1 is a perspective view showing an ink jet recording device according to the present invention.
Figure 2:
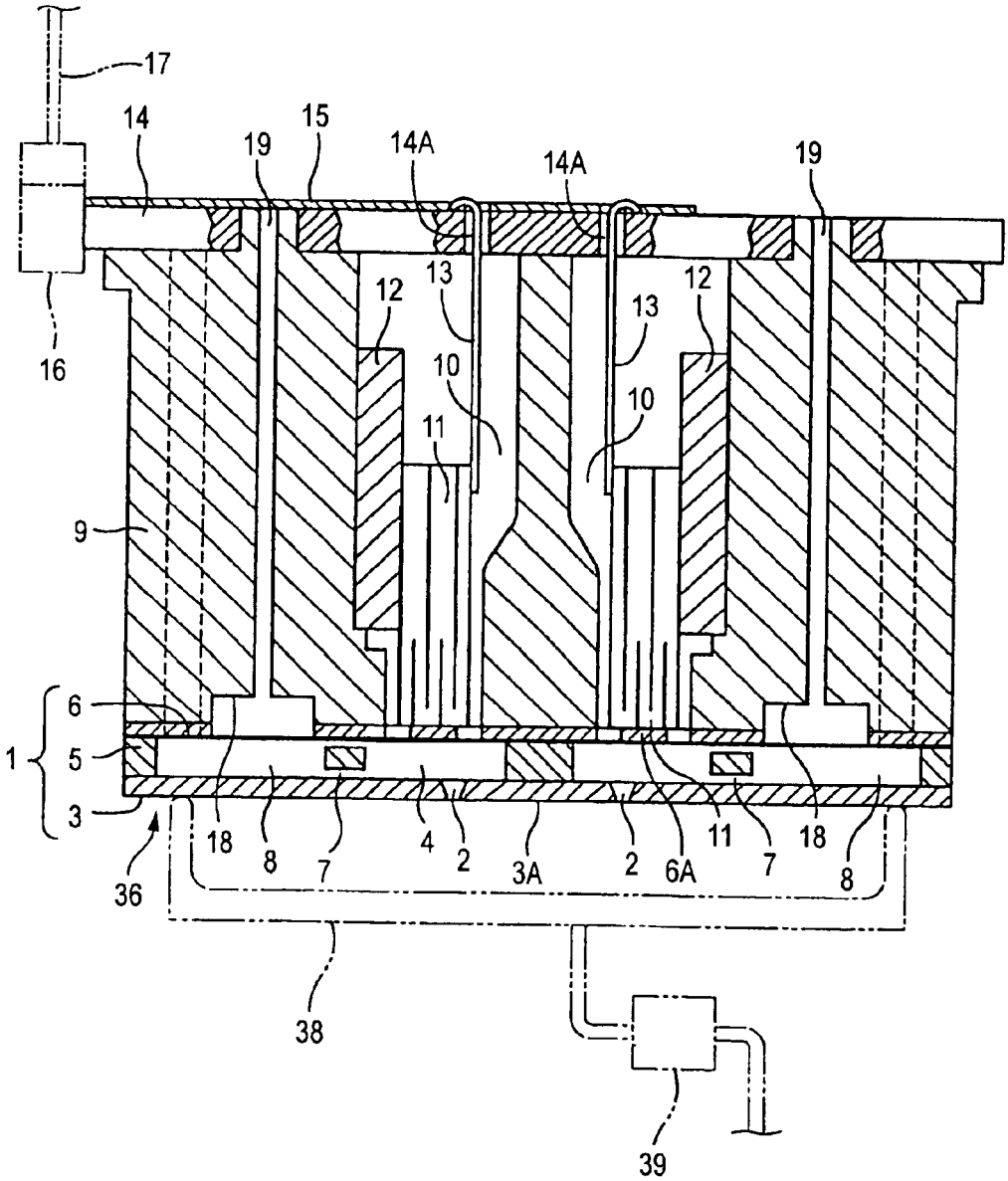
FIG. 2 is a cross sectional view showing a recording head of the ink jet recording device.
Figure 6:
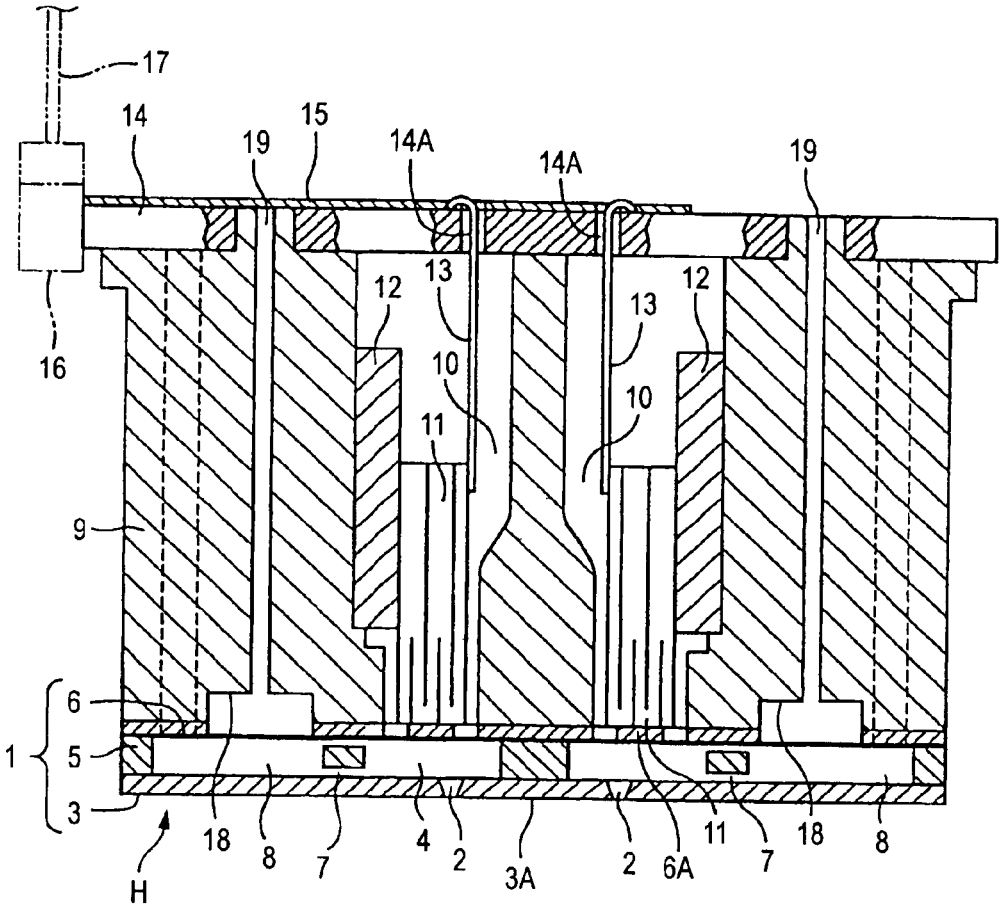
FIG. 6 is a cross sectional view showing a recording head of a conventional ink jet recording device.
Figure 7:
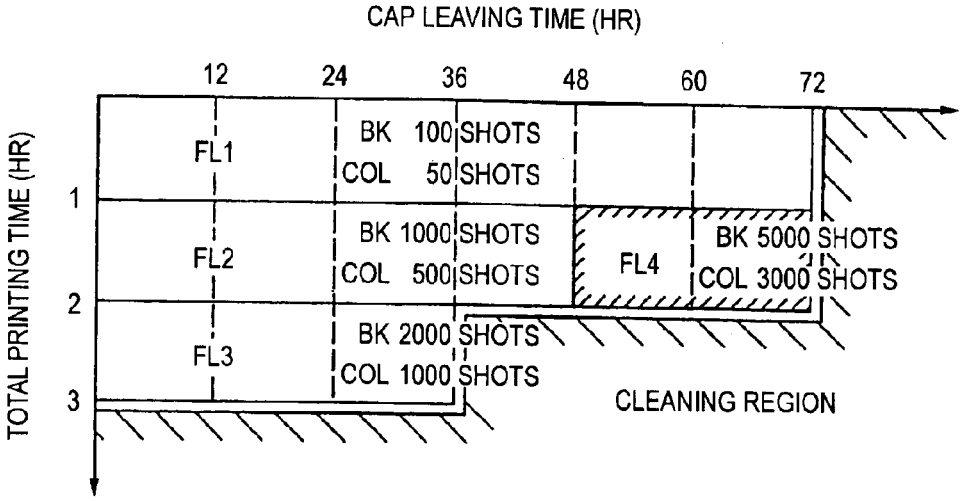
FIG. 7 is a chart useful in explaining mode select conditions which are defined by the cap leaving time and the printing time, which the conditions are applied to the related ink jet recording device.

FIG. 1 is a perspective view showing a peripheral structure of an ink jet recording device according to the present invention. FIG. 2 is a cross sectional view showing a recording head 36, which is similar to the recording head H already described referring to FIG. 6. In FIG. 6, like or equivalent portions are designated by like reference numerals used in FIG. 2.

The ink jet recording device includes a carriage 31 and a capping device 38. The carriage 31 includes six ink cartridges 37 mounted in an upper part thereof, and a recording head 36 mounted on a lower surface thereof. The capping device 38 is provided for sealing the recording head 36. In the embodiment, six ink cartridges 37 containing respectively cyan (C), light cyan (LC), magenta (M), light magenta (LM), yellow (Y), and black (BK) are mounted on the carriage.

The carriage 31 is coupled to a stepping motor 33 by a timing belt 32, and is reciprocatively moved in a width direction of a recording sheet 35, while being guided by a guide bar 34. The recording head 36 is mounted on a surface (lower surface in this instance) of the carriage 31, which faces the recording sheet 35. Inks are fed to the recording head 36, from the ink cartridges 37. The recording head ejects ink drops onto the recording sheet 35, while moving the carriage 31, to thereby images and characters are printed on the recording sheet 35 by a dot matrix method.

The capping device 38 is located in a non-print region within a movement range of the carriage 31. When the recording head is not used or operated for printing, the capping device seals the nozzle orifices 2 for preventing the drying of the nozzle orifices 2. The capping device 38 is also used as a receptacle for receiving ink drops that is ejected from the recording head 36 in the flushing operation. Further, the capping device 38 is coupled to a suction pump 39. In the cleaning operation, the capping device applies a negative pressure to the nozzle orifices 2 of the recording head 36 so that the ink is sucked from the nozzle orifices 2.

FIG. 2 is a cross sectional view showing an example of the recording head 36. The recording head 36 is similar to the recording head H already described referring to FIG. 6. In FIG. 6, like or equivalent portions are designated by like reference numerals used in FIG. 2. In the figure, the capping device 38 and the suction pump 39 are indicated by two-dot chain lines.

Figure 3:
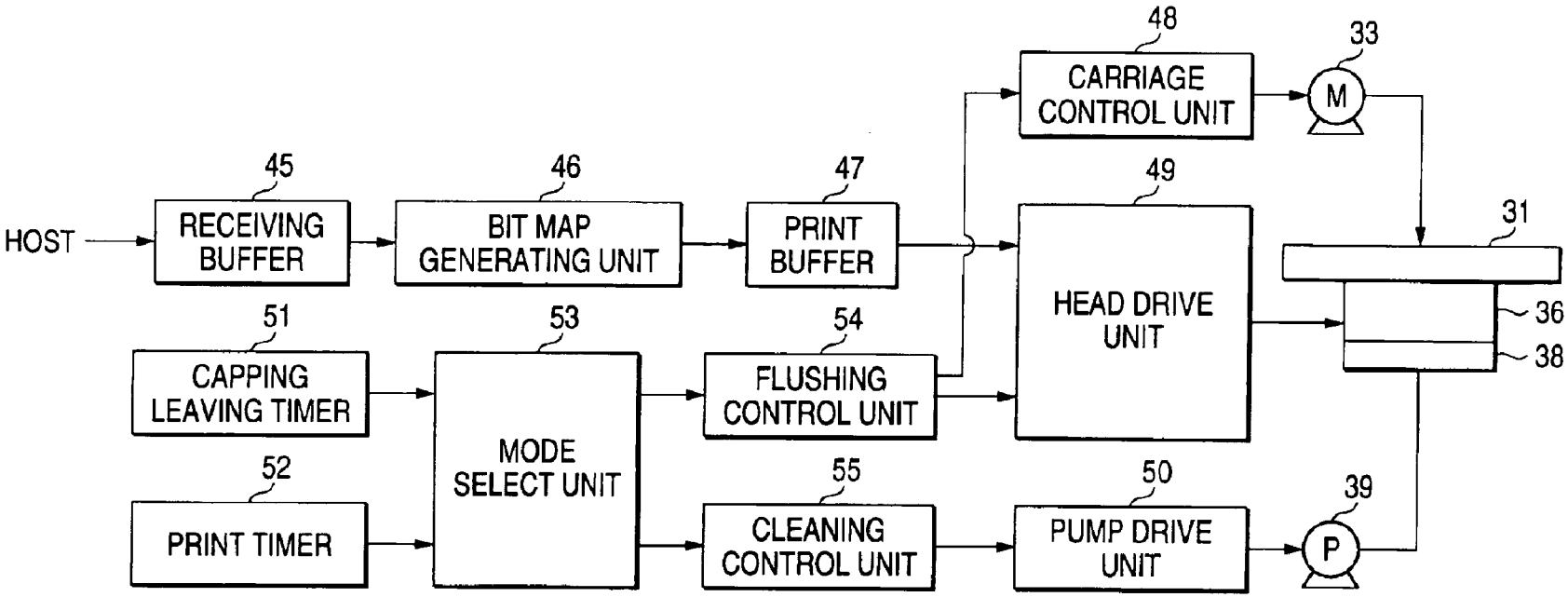
FIG. 3 is a block diagram showing a system configuration of an ink jet recording device according to the invention.

FIG. 3 is a block diagram showing a system configuration of the ink jet recording device. In the figure, a receiving buffer 45 receives print data from a host computer (not shown), a bit map generating unit 46 converts the print data into bit map data, and a print buffer 47 temporarily stores the bit map data.

Reference numeral 49 designates head drive unit. The head drive unit executes a printing operation in which a drive signal is applied to the pressure generating element 11 so that ink drops are ejected from the recording head 36 in accordance with a print signal from the print buffer 47. Further, at a timing of the flushing operation, the head drive unit executes the flushing operation in which a drive signal is applied to the pressure generating element 11 independently of a print signal so that ink drops are ejected from the nozzle orifices 2 of the recording head 36.

Reference numeral 50 designates a pump drive unit. The pump drive unit 50 executes a cleaning operation in which a negative pressure is applied from the suction pump 39 to the recording head 36 when the recording head 36 is sealed with the capping device 38 to forcibly suck the ink from the nozzle orifices 2.

Reference numeral 48 designates carriage control unit. At the time of printing, the carriage control unit 48 drives a stepping motor 33 which in turn moves the carriage 31 to scan the recording head 36. Further, in the flushing operation or at the end of printing, the carriage control unit 48 moves the carriage 31 to a position where the capping device 38 is confronted with the recording head 36.

Reference numeral 51 designates a cap leaving timer. When it is detected, based on a signal from the carriage control unit 48 or the like, that the recording head 36 is sealed with the capping device 38, the cap leaving timer 51 is driven to measure a cap leaving time that the recording head 36 is left while being sealed with the capping device 38. Specifically, the cap leaving timer 51 measures an accumulative time (referred to as a "leaving time") that the nozzle orifices 2 are kept in a sealing state, and is reset at a time point that the cleaning operation is performed.

Reference numeral 52 is a print timer. When a start of printing operation is detected by use of signals from the head drive unit 49 and the carriage control unit 48 or the like, the print timer 52 is driven to measure a printing time ranging from an instant that the recording head 36 is released from the capping device 38 till the recording head 36 is sealed with the capping device 38 again. Specifically, the print timer 52 measures an accumulative time (referred to as a "total printing time") that the ink drops are ejected, and is reset at a time point that the cleaning operation is executed.

Reference numeral 53 indicates mode select unit. The mode select unit 53 receives signals representative of a leaving time and a total printing time from the cap leaving timer 51 and the print timer 52, and selects a flushing mode to perform the flushing operation or a cleaning mode to perform the cleaning operation on the basis of a correlation between the leaving time and the total printing time and various conditions to be described later, and outputs a signal indicating the selected mode.

Reference numeral 54 is flushing control unit. The flushing control unit 54 receives a signal from the mode select unit 53, and causes the head drive unit 49 to apply a drive voltage to the pressure generating element 11. Upon receipt of the drive signal, the pressure generating element 11 is repeatedly expanded and contracted to vibrate. And, the flushing control unit 54 controls the flushing operation in which the recording head is caused to eject ink drops from the nozzle orifices 2 under various conditions. Reference numeral 55 is cleaning control unit. The cleaning control unit 55 receives a signal from the mode select unit 53 and controls the cleaning operation by the pump drive unit 50.

Figure 4:
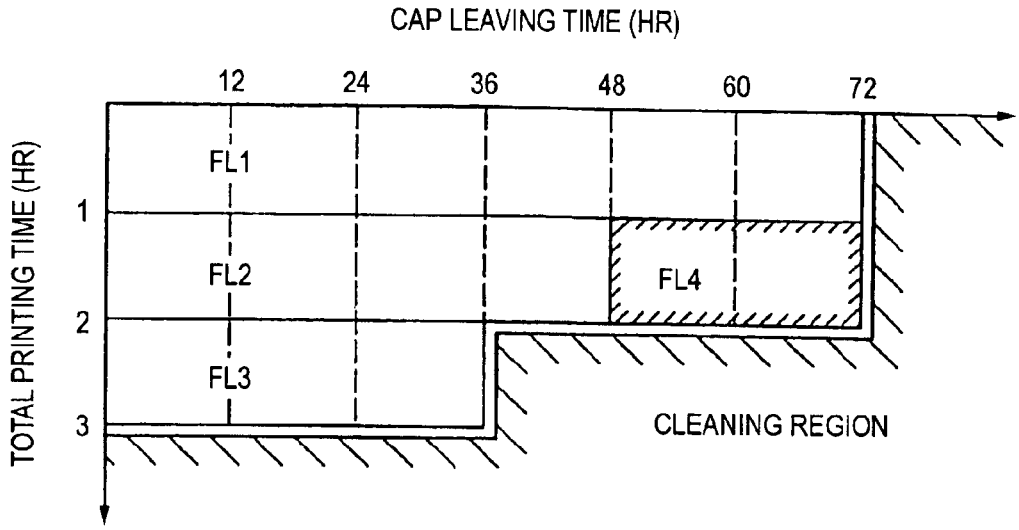
FIG. 4 is a chart useful in explaining mode select conditions which are defined by the cap leaving time and the printing time in the liquid ejecting device.

FIG. 4 is a chart useful in explaining mode select conditions for selecting one of the recovery modes, which are determined by a correlation between the leaving time and the total printing time in the ink jet recording device. The instant chart for determining the mode select conditions is designed to have a flushing region and a cleaning region. A flushing mode is assigned to the flushing region, and a cleaning mode is assigned to the cleaning region. The flushing mode consists of four flushing modes FL1 to FL4, which are respectively defined by recovery levels In this instance, a time scale of the total printing time (Hr) contains three reference time values, 1, 2 and 3 hours. A time scale of the leaving time (Hr) contains six reference values 12, 24, 36, 48, 60 and 72 hours. An area hatched in FIG. 4 is the cleaning region in which the cleaning mode is selected. An area defined by the time values, which are smaller than those of the cleaning mode, is the flushing region.

A mode FL1 in the flushing region is defined by the total printing time of smaller than 1 hour and the leaving time of smaller than 72 hours. A mode FL2 is defined by the total printing time from 1 hour to a time value of smaller than 2 hours, and the leaving time of smaller than 48 hours. A mode FL3 is defined by the total printing time from 2 hours to a time value of smaller than 3 hours, and the leaving time of smaller than 36 hours. A mode FL4 is defined by the total printing time from 1 hour to a time value of smaller than 2 hours, and the leaving time from 48 hours to a time value of smaller than 72 hours.

The modes FL1 to FL4 are determined by environmental factors, such as temperature and humidity, at a location where the ink jet recording device is installed, in addition to factors, such as viscosity increasing rates of various kinds of inks and the amount of consumed ink. For example, in a high temperature environment where the water content of the ink is easy to evaporate, the mode FL4 is formed to be wide so that the flushing operation of the mode FL4 starts when the leaving time and the total printing time are relatively short. Thus, in particular in the mode FL4 as a highly increased viscosity region, a property change of the ink is remarkable. Therefore, it is effective to allow for the environmental factors as mentioned above in forming the flushing mode. Not only the mode FL4 but also the modes FL1 to FL3 and the cleaning region may be formed by considering the environmental factors.

In the flushing operation of the modes FL1 to FL4, an amount of ejected ink may be defined by using a continuous ink ratio. In the embodiment, however, the ink of the highly increased viscosity is removed by instantaneous ejections of ink of a pulsatory ink ratio. Accordingly, the ink ejection amount is expressed in terms of the number of ink ejections, i.e., the number of shots of ink.

The flushing conditions in the modes FL1 to FL3 are exemplarily listed below:

| | |
|---|---|
| Mode FL1 | |
| Black ink (BK) | 100 shots/nozzle |
| Color ink COL) | 50 shots/nozzle |
| Mode FL2 | |
| Black ink (BK) | 1000 shots/nozzle |
| Color ink COL) | 500 shots/nozzle |
| Mode FL3 | |
| Black ink (BK) | 2000 shots/nozzle |
| Color ink COL) | 1000 shots/nozzle |

To determine the number of shots in the mode FL4, two modes are used for the mode FL4; a mode (first mode) FL4 used in a print job which is first executed after power on, and a mode (second/subsequent mode) FL4 used in a print job which is second and subsequently executed. The numbers of shots in the first mode and the second/subsequent mode are:

| | |
|---|---|
| Mode FL4 (first mode) | |
| Black ink (BK) | 5000 shots/nozzle |
| Color ink (COL) | 3000 shots/nozzle |
| Mode FL4 (second/subsequent mode) | |
| Black ink (BK) | 1000 shots/nozzle |
| Color ink (COL) | 500 shots/nozzle |

The ink ejection amount (the number of shots) in the flushing operation of the modes FL1 to FL4 may also be determined allowing for the environmental factors, such as temperature and humidity. If the ink ejection amount in the winter season and cold districts is set to be larger than that in the summer season and warm temperature districts, the ink ejection amount in the flushing operation, which is adapted for the environmental conditions, is secured. In a high temperature environment where the water content in the ink is easy to evaporate, the removal of the ink of a highly increased viscosity is more perfect by increasing the ink ejection amount in the flushing operation. In particular, in the mode FL4 (first mode) as the highly increased viscosity region, a level of change of ink property is remarkably high. Accordingly, in this mode, it is effective to take the environmental conditions into consideration in determining the ink ejection amount. Also in the modes FL1 to FL3 and the cleaning region, the environmental conditions may be taken into consideration in determining the ink ejection amount.

Figure 5:
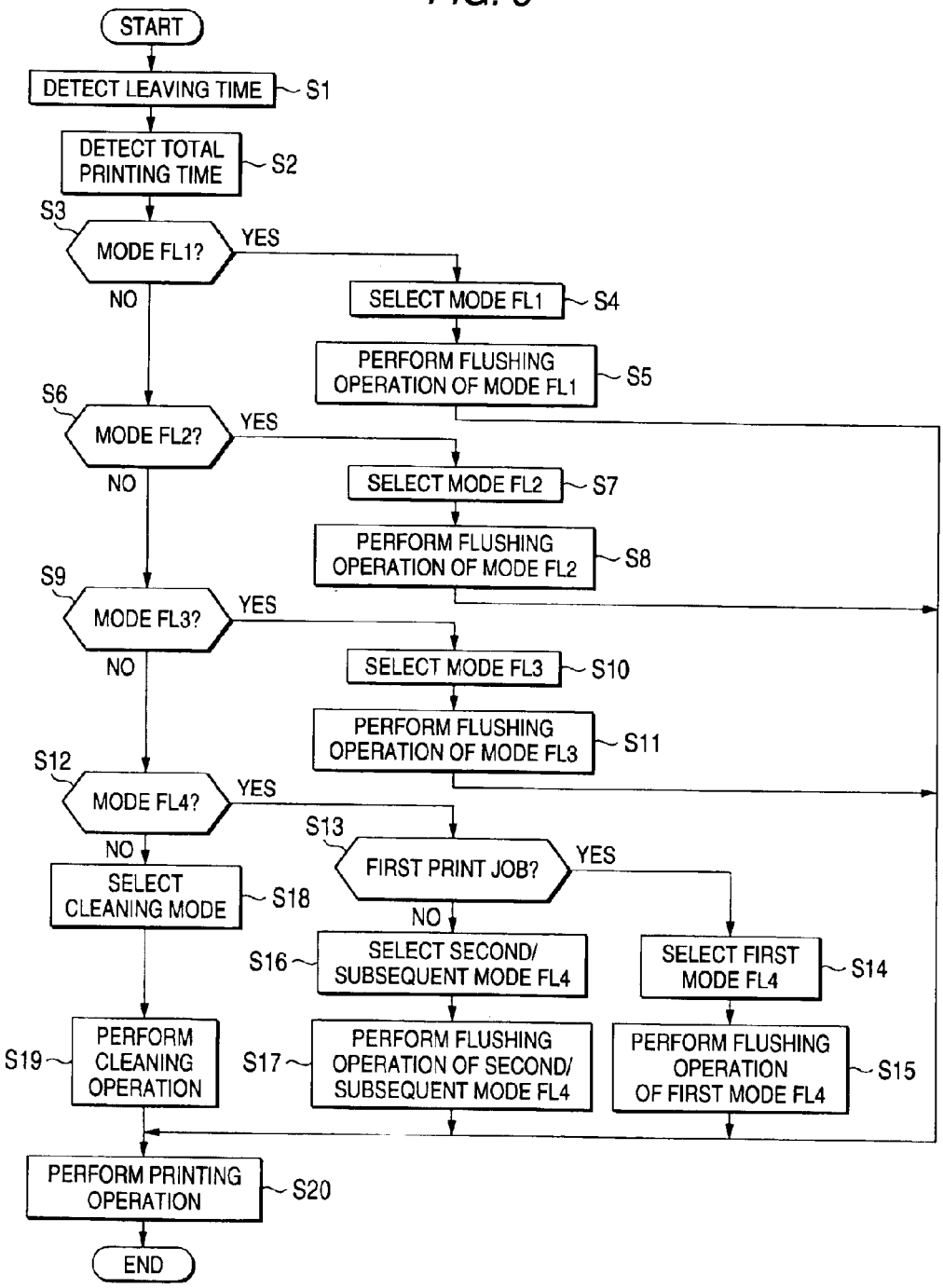
FIG. 5 is a flow chart diagrammatically describing operations of the liquid ejecting device.

Operations of the ink jet recording device will exemplarily be described referring to a flow chart shown in FIG. 5. In the figure, a capital letter "S" means a procedural step.

To start with, the ink jet recording device receives print signals of one job from a host computer. At the start of the print job, the cap leaving timer 51 counts a leaving time, while the print timer 52 counts a total printing time (S1 and S2). Then, the mode select unit 53 determines whether the recovery mode is set to the mode FL1, while referring to a correlation between the leaving time and the total printing time (see FIG. 4) (S3). When the recovery mode is set to the mode FL1, the mode FL1 is selected (S4), the flushing operation of the mode FL1 is performed (S5), and a printing operation is performed (S20). When the recovery mode does not set to the mode FL1 in the step S3, the mode select unit determines whether the recovery mode is set to the mode FL2 (S6).

When the recovery mode is set to the mode FL2 in the step S6, the mode FL2 is selected (S7), the flushing operation of the mode FL2 is performed (S8), and a printing operation is performed (S20). When the recovery mode does not set to the mode FL2 in the step S6, determination is made as to whether or not the recovery mode is set to the mode FL3 (S9).

When the recovery mode is set to the mode FL3 in the step S9, the mode FL3 is selected (S10), the flushing operation of the mode FL3 is performed (S11), and a printing operation is performed (S20). When the recovery mode does not set to the mode FL3 in the step S9, determination is made as to whether or not the recovery mode is set to the mode FL4 (S12).

When the recovery mode is set to the mode FL4 in the step S12, the flushing control unit determines whether or not a current job is a job that is first executed after power on (S13).

When the job is the jot that is first executed, the first mode FL4 is selected (S14), a flushing operation of the first mode FL4 is performed (S15), and a printing operation is performed (S20). In the first mode FL4, the job to be executed is the job to first be executed after power on. Accordingly, it is estimated that a relatively long time has elapsed from a previous use of the ink jet recording device. Accordingly, a viscosity of the ink at and near the nozzle orifices 2 has been increased considerably. In the first flushing operation, as already described, inks are ejected by predetermined numbers of shots of ink, that is, the black ink (BK) is 5000 shots and Color ink (COL) is 3000 shots.

When it is determined that the job to be executed is not the job first executed in the step S13, a second/subsequent mode FL4 is selected (S16), a flushing operation of the second/subsequent mode is performed (S17), and then a printing operation is performed (S20). The second/subsequent mode FL4 is executed following the previous job, while being in a power-on state. The first mode FL4 is already executed. The viscosity at and near the nozzle orifices 2 is recovered to some extent since the first flushing operation is already performed. Therefore, the inks are ejected by, for example, the following numbers of shots, that is the black ink (BK) is 1000 shots and color ink (COL) is 500 shots. Those numbers of shots are considerably smaller than those of 5000 shots of black ink (BK) and 3000 shots of color ink COL in the first flushing operation.

When use of the recording head in a power-on state continues, and so long as the flushing mode executed for each job start is set to the mode FL4, the flushing operation is successively performed in the second/subsequent mode FL4.

When the recovery mode does not set to the mode FL4 in the step S12, the next cleaning mode is selected (S18) and performed (S19), and subsequently a printing operation is performed (S20). By performing the cleaning operation in the step S19, the cap leaving timer 51 an the print timer 52 are reset, and the leaving time and the total printing time are returned to their initial time values, and the next recovery mode is the flushing mode of the mode FL1.

When the power is turned off in a state that the flushing mode is set to the mode FL4, the leaving time and the total printing time are kept in an accumulative state, and the flushing operation of the first mode FL4 is performed before a first job is executed when the power is next turned on.

In the above embodiment, the ink of highly increased viscosity is removed by the first flushing operation in which the inks are ejected by predetermined numbers of shots. As a result, the nozzle orifices 2 are prepared for its normal ink ejection. When the second and subsequent flushing operations are performed in the mode FL4 as a highly increased viscosity region, an amount of ink consumed by that flushing operation is smaller than that by the first flushing operation. Therefore, a time taken for the second and subsequent flushing operations is reduced, and hence, an operation time of the recording head 36 of the ink jet recording device is reduced. The second and subsequent flushing operations are controlled in a minimum level, so that an amount of fresh ink consumed by the flushing operation is minimized, and an economical ink jet recording device is provided.

The recovering operation is performed before an operation job starts, which the operation job consists of an operation of the recording head 36 ranges from an instant that the recording head 36 receives a one-operation command signal and starts the ink drop ejection till it ends the ink drop ejection. Therefore, the recovering operation is performed before a printing operation of, for example, one document to be printed starts. Accordingly, when the document is printed, the ink of a highly increased viscosity at and near the nozzle orifices 2 has completely been removed. Hence, a normal ink ejection is secured. And, a print of a good print quality is secured.

The highly increased viscosity region (mode FL4) is determined allowing for environmental conditions, such as temperature and humidity, at a location where the recording head 36 is disposed. Accordingly, the highly increased viscosity region is set depending on other various conditions and the environmental conditions as well. Accordingly, an optimum highly increased viscosity region which is adaptable for every condition around the head is realized. Accordingly, a flushing operation which is most suitable for changes of ink properties of the ink whose viscosity is highly increased may be performed.

The amount of ink consumed in the flushing operation is changed allowing for environmental conditions, such as temperature and humidity, at a location where the recording head 36 is disposed. For example, in the winter season and cold districts, the ink amount consumed by the flushing operation is changed to be larger than that in the summer season and warm districts. By so doing, the ink amount consumed by the flushing operation which is adaptable for the environmental conditions is secured. Accordingly, a good recovering operation is performed at and near the nozzle orifices.

The first flushing operation is first performed after the power to the ink jet recording device is turned on. Therefore, the first flushing operation is performed after the power-on operation which is always performed before the printing operation. The flushing operation to first be performed is performed without fail. The recovery at and near the nozzle orifices 2 is reliably achieved. The second and subsequent operation jobs, which are executed in a state that the power source of the ink jet recording device is in an on state, are frequently executed after not so long time elapses from the execution of the first operation job. Therefore, the function of the nozzle orifices can surely be recovered even if an ink ejection amount smaller than that for the first operation job is used.

An ink ejection amount in the first flushing operation in the highly increased viscosity region FL4 is larger than that in the flushing operations in the regions other than the highly increased viscosity region FL4. Accordingly, a time taken for the recovering operation performed for each operation job in that region and an amount of waste ink are larger than those in other regions. In this respect, the effect to reduce the ink ejection amounts in the second and subsequent flushing operations is remarkable. A flushing operation is performed by the ink ejection of an ink ejection amount suitable for an viscosity increase degree. In particular, the recovering operation is performed by use of the ejection ink whose amount is increased as the result of removing the ink having the highest viscosity increase degree. A more exact recovering operation is performed at and near the nozzle orifices 2.

When the liquid is an ink for printing and it is used for an ink jet recording device, the flushing operation as mentioned above is applied to a property change of the ink, so that a normal ink ejection is secured and a good print quality is ensured. Further, a small space for storing the waste ink is required. This feature is advantageous to the device size reduction.

When the printing ink is increased in its viscosity at and near the nozzle orifices and becomes a property changed ink, the ink whose viscosity is increased at and near the nozzle orifices 2 of the recording head 36 of the ink jet recording device is removed by the first flushing operation in the highly increased viscosity region FL4 which requires the flushing operation, so that the nozzle orifices are prepared for their normal ink ejection. Since the ink ejection amount in the second and subsequent flushing operations is smaller than that in the first flushing operation, the flushing operation performed before the printing of a second document, for example, starts is completed for a short time, and the amount of ink ejected is small. This provides an economical feature of the invention. Accordingly, a rational recovering operation is secured in the highly increased viscosity region having a high viscosity increase degree, which is determined by a correction between an accumulative time that the nozzle orifices 2 is left in a sealed state and an accumulative time that the ink ejection is performed.

In the embodiment mentioned above, the first flushing operation and the second and subsequent flushing operations are performed in only the mode FL4. A mode area of the mode FL3 of the leaving time of 24 hours or longer may be incorporated into the mode in which the first flushing operation and the second and subsequent flushing operations are performed, if required.

A time elapsing from the first flushing operation to the second flushing operation is measured. A flushing operation condition of the second flushing operation, for example, the number of shots of ink, may be adjusted depending on the length of the measured elapsing time. A viscosity increase degree of the ink at and near the nozzle orifices 2 varies in proportion to the elapsing time. Accordingly, the second flushing operation is performed in conformity with the variation of the viscosity increase degree. Further, if required, a time elapsing from the second flushing operation to the third flushing operation is measured, and the flushing operation is controlled in accordance with the measured elapsing time in a similar way.

The liquid ejecting head discussed in the embodiment mentioned above is the recording head used for the ink jet recording device. It should be understood that the liquid ejecting head of the invention may also be used for ejecting glue, sample liquid, conductive liquid (liquid metal) and others, in addition to the ink for the ink jet recording device.

What is claimed is:

1. A liquid ejecting device, comprising:

a liquid ejecting head, having a nozzle formation face on which nozzle orifices for ejecting liquid drops are formed; and a controller, which performs a recovery operation for removing liquid drops having a changed liquid property, the liquid drops being at and near the nozzle orifices;

wherein the recovery operation is performed by using at least a flushing mode in which liquid drops are ejected in a state that the nozzle formation face is sealed;

wherein the controller selectively performs a plurality of flushing modes which are set in accordance with degrees in change of a liquid property of the liquid drops being at and near the nozzle orifices;

wherein the degrees in change of the liquid property of the liquid drops are determined by a relation between an accumulative time that the nozzle orifices are left in a sealing state and an accumulative time that a liquid ejection is executed;

wherein a high flushing mode of the flushing modes for removing the liquid having a high degree in change of the liquid property has a first flushing mode which is performed at a first time and second and subsequent flushing modes which is performed at a second and subsequent time; and wherein the number of liquid drops ejected in the first flushing mode is greater than the number of liquid drops ejected in the second and sequent flushing modes.

2. The liquid ejecting device as set forth in claim 1, wherein the recovery operation is performed before an operation job is executed; and wherein the operation job is executed during from an instant that the liquid ejecting head starts a liquid ejection in response to an operation command signal applying thereto till the liquid ejecting head ends the liquid ejection.

3. The liquid ejecting device as set forth in claim 1, wherein ranges of the degrees in change of the liquid property which are correspond to the flushing modes respectively are defined in accordance with an environmental condition having at least one of temperature and humidity at a location where the liquid ejecting device is disposed.

4. The liquid ejecting device as set forth in claim 1, wherein a liquid ejection amount in at least one of the flushing modes is changed in accordance with an environmental condition having at least one of temperature and humidity at a location where the liquid ejecting device is disposed.

5. The liquid ejecting device as set forth in claim 1, wherein the first flushing mode is initially performed after the power to the liquid ejecting device is turned on.

6. The liquid ejecting device as set forth in claim 1, wherein a liquid ejection amount in the first flushing mode of the high flushing mode is larger than that in the flushing modes other than the high flushing mode.

7. The liquid ejecting device as set forth in claim 1, wherein the liquid is an ink for printing and is used for an ink jet recording device.

8. The liquid ejecting device as set forth in claim 7, wherein the liquid having a changed liquid property is an ink increased in its viscosity at and near the nozzle orifices.

9. The liquid ejecting device as set forth in claim 1, further comprising a capping member which seals the nozzle formation face.

* * * * *